United States Patent [19]

Kim

[11] Patent Number: 4,954,113

[45] Date of Patent: Sep. 4, 1990

[54] LIGHT BULB HAVING A MULTICOLORED DESIGN AND METHOD OF MANUFACTURING THEREOF

[76] Inventor: Young G. Kim, Oyang Apt. 3-505, Kwang-An 4-Dong Nam-ku, Pusan, Rep. of Korea

[21] Appl. No.: 368,608

[22] Filed: Jun. 20, 1989

[30] Foreign Application Priority Data

May 9, 1989 [KR] Rep. of Korea ..... 89-6146

[51] Int. Cl.[5] ..... H01J 9/20

[52] U.S. Cl. ..... 445/58; 427/106

[58] Field of Search ..... 313/112; 445/58; 427/106, 146; 156/155

[56] References Cited

U.S. PATENT DOCUMENTS

| | | | |
|---|---|---|---|
| 1,996,549 | 4/1935 | McNutt | 156/155 X |
| 2,111,897 | 3/1938 | McNutt | 156/155 X |
| 2,512,929 | 6/1950 | Galbraith et al. | 156/155 X |
| 2,629,670 | 2/1953 | Rathke | 156/155 X |
| 3,188,227 | 6/1965 | Vodicka et al. | 427/106 |
| 3,506,473 | 4/1970 | Ettre | 156/155 X |

*Primary Examiner*—Kenneth J. Ramsey

*Attorney, Agent, or Firm*—Birch, Stewart, Kolasch & Birch

[57] ABSTRACT

A process for printing a light bulb having a multicolored design which comprises the steps of attaching a transfer film having a multicolored design onto the surface of a conventional light bulb, and burning the transfer film attached to the light bulb at a temperature of about 550°-650° C. so as to leave the multicolored design on the surface of the light bulb which exhibits high durability and an excellent appearance of beauty.

4 Claims, 1 Drawing Sheet

FIG. 1
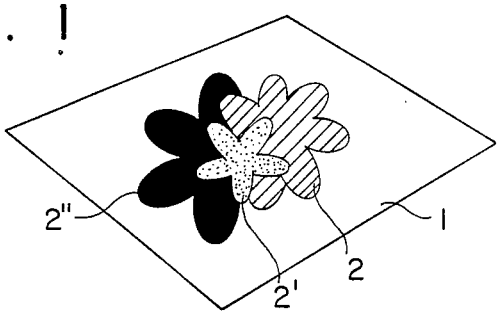
FIG. 2A
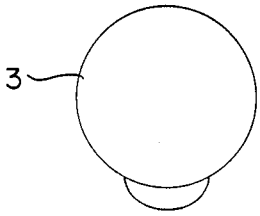
FIG. 2B
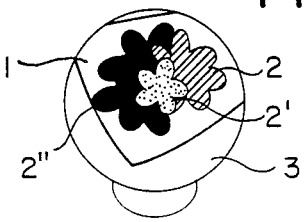
FIG. 2C
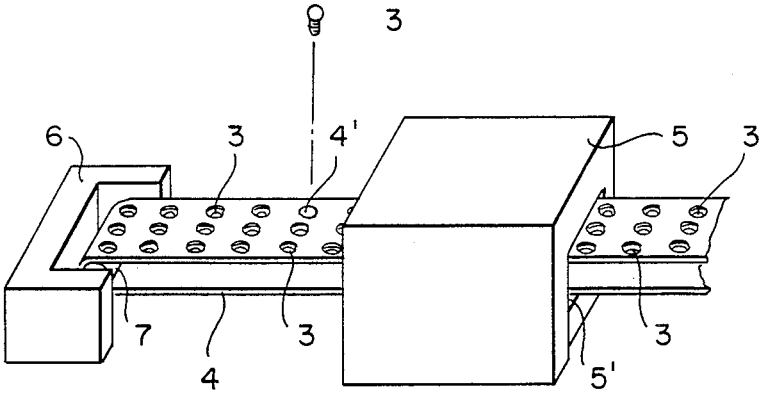
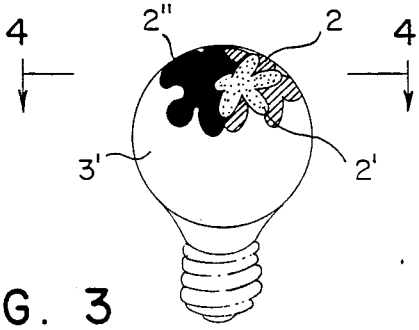
FIG. 3
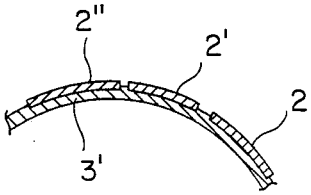
FIG. 4

LIGHT BULB HAVING A MULTICOLORED DESIGN AND METHOD OF MANUFACTURING THEREOF

BACKGROUND OF THE INVENTION

1. Field of the Invention

The present invention relates to a light bulb having a multicolored design and method of manufacture thereof and more particularly, to a method for manufacturing a light bulb having a multicolored design disposed on the surface thereof which has an excellent durability and an excellently refined appearance and its manufacture.

2. Description of the Prior Art

There are various light bulbs having a multicolored design manufactured from a screen printing method of a transfer film. However, since methods for producing such light bulbs usually use ceramic ink or glass ink, the multicolored designs of such light bulbs do not have a high durability so that the multicolored designs of such light bulbs gradually lose color and peel off from the surface of such light bulbs. Therefore, such light bulbs having a multicolored design do not exhibit excellent beauty in appearance.

SUMMARY OF THE INVENTION

Accordingly, it is an object of the present invention to provide an improved light bulb having a multicolored design disposed on the surface thereof and an improved process for its manufacture.

Another object of the present invention is to provide a process for printing a highly durable multicolored light bulb which comprises burning at a temperature of about 550°-650° C. for about 1-2 hours, preferably about 600° C. for 1 hour and 30 minutes, a light bulb adapted to be attached to a transfer film with a multicolored design printed thereon, so as to produce a light bulb which has excellent durability and an excellent refined appearance.

A further object of the present invention is to provide an improved light bulb having a multicolored design disposed on the surface thereof wherein the multicolored design does not peel off therefrom and wherein the design can be printed on the surface of any type of used or new light bulb.

Still another object of the present invention is to provide a light bulb having a multicolored design disposed on the surface thereof, which is simple in construction, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a process for printing a light bulb having a multicolored design which comprises the steps of attaching a transfer film having a multicolored design onto the surface of conventional light bulb, and burning the attached transfer film on the light bulb at a temperature of about 550°-650° C. for about 1-2 hours, preferably about 600° C. for 1 hour and 30 minutes, so as to leave the multicolored design on the surface of the light bulb, which has a high durability and an excellent appearance of beauty.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a top plan view of a transfer film printed by a multicolored design according to the present invention;

FIG. 2(A), 2(B), and 2(C) illustrate manufacturing process steps according to the present invention;

FIG. 3 is a perspective view of the multicolored light bulb according to the present invention; and FIG. 4 is a sectional view of FIG. 3, taken along line 4—4.

DESCRIPTION OF THE PREFERRED EMBODIMENTS

Referring now in detail to the drawings for the purpose of illustrating preferred embodiments of the present invention, the burning apparatus as shown in FIG. 2(C) comprises a burning chamber 5, a tunnel 5' disposed therewithin, a conveyor belt 4 having a plurality of apertures 4' receiving a plurality of light bulbs 3, a pair of rollers 7 for rotating the conveyor belt 3, and a pair of supports 6 for supporting the pair of rollers 7.

According to the present invention, the method for manufacturing a light bulb 3' having a multicolored design proceeds as follows:

As shown in FIGS. 1, 2(A), 2(B), and 2(C), a transfer film 1, first of all, is printed by multicolored designs 2, 2', and 2'' (FIG. 1). The printed transfer film 1 is attached onto the surface of the light bulb 3 with water (FIG. 2(B)). The transfer film attached bulbs 3 are put into the plurality of apertures 4' disposed in the conveyor belt 4 which is rotated by the pair of rollers 7 supported by the pair of supports 6. The conveyor belt 4 containing the plurality of printed transfer film attached light bulbs 3 passes through the tunnel 5' of the burning chamber 5 at a temperature of about 550°-650° C. for about 1-2 hours, preferably about 600° C. for 1 hour 30 minutes. At this time, the transfer film 1 is burned except the multicolored designs 2, 2', and 2'' to produce the light bulb 3' having multicolored designs 2, 2', and 2'' (FIGS. 3 and 4).

The light bulb 3' having the multicolored designs 2, 2', and 2'' manufactured by the above-mentioned process according to the present invention has high and excellent durability and a excellently refined appearance. Further, the multicolored designs 2, 2', and 2'' of the light bulb 3' do not discolor and do not peel off from the surface of the light bulb 3'. Accordingly, the light bulb 3' according to the present invention has an excellent sense of beauty. Furthermore, the light bulb 3 may be a used or a new bulb, or any type of conventional light bulb.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A method for manufacturing a light bulb having a multicolored design which comprises the steps of:

(a) printing on a transfer film a multicolored design, (b) attaching said transfer film with printed multicolored design onto the surface of a light bulb, and (c) burning said light bulb with said transfer film with multicolored design attached thereto at a temperature of about 550°–650° C. for 1–2 hours so as to manufacture said light bulb having a multicolored design, said transfer film attached onto the surface of the light bulb being substantially burned away leaving said multicolored design in a burning chamber which contains a tunnel for passing a conveyor belt having a plurality of apertures for receiving a plurality of said light bulbs to be burned.

2. The method of claim 1, wherein the conveyor belt is rotated by a pair of rollers supported by a pair of supports.

3. A light bulb having a multicolored design disposed on the surface thereof which is produced by the method of claim 1, said multicolored design having durability and appearance of beauty.

4. The method of claim 1, wherein the burning of step (c) is conducted at a temperature of about 600° C. for 1 hour and 30 minutes.

* * * * *